US011008807B2

(12) United States Patent
Chen et al.

(10) Patent No.: US 11,008,807 B2
(45) Date of Patent: May 18, 2021

(54) POSITION-FIXING SYSTEM

(71) Applicant: Nien Made Enterprise Co., Ltd., Taichung (TW)

(72) Inventors: Lin Chen, Taichung (TW); Keng-Hao Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 272 days.

(21) Appl. No.: 16/164,744

(22) Filed: Oct. 18, 2018

(65) Prior Publication Data

US 2020/0123853 A1 Apr. 23, 2020

(51) Int. Cl.

| | |
|---|---|
| ***E06B 9/90*** | (2006.01) |
| ***E06B 9/42*** | (2006.01) |
| *E06B 9/80* | (2006.01) |
| *E06B 9/88* | (2006.01) |
| *E06B 9/322* | (2006.01) |

(52) U.S. Cl.

CPC ..... *E06B 9/90* (2013.01); *E06B 9/42* (2013.01); *E06B 9/322* (2013.01); *E06B 9/80* (2013.01); *E06B 9/88* (2013.01); *E06B 2009/807* (2013.01)

(58) Field of Classification Search

CPC ..... E06B 9/90; E06B 9/80; E06B 9/82; E06B 9/84; E06B 9/42; E06B 9/88; E06B 9/322; E06B 2009/807; F16D 49/08; F16F 7/02; F16F 7/06

See application file for complete search history.

(56) References Cited

U.S. PATENT DOCUMENTS

2014/0374036 A1* 12/2014 Chen ..... E06B 9/90 160/313
2015/0284999 A1* 10/2015 Liu ..... E06B 9/80 242/396
2017/0067289 A1* 3/2017 Campagna ..... E06B 9/72

* cited by examiner

*Primary Examiner* — Johnnie A. Shablack
*Assistant Examiner* — Matthew Richard Shepherd
(74) *Attorney, Agent, or Firm* — Winston Hsu

(57) ABSTRACT

A position-fixing system for a window covering, which has a roller tube, includes a variable diameter screw, a guiding portion, and an elastic member. The variable diameter screw has a working section gradually broadening in a radial direction thereof. The guiding portion extends along an inner wall of the roller tube in an axial direction thereof. The elastic member fits around the variable diameter screw, and is movable along the guiding portion. The elastic member has a meshing portion provided on an inner side thereof to mesh with the working section, and a guided portion provided on an outer side thereof to slide along the guiding portion. When the roller tube rotates in a direction, the elastic member moves along the working section and deforms, whereby to exert a gradually increasing unit tightening force to the variable diameter screw in the radial direction, dampening its rotation.

20 Claims, 18 Drawing Sheets

POSITION-FIXING SYSTEM

BACKGROUND OF THE INVENTION

1. Field of the Invention

The present invention relates generally to a position-fixing system, and more particularly to a position-fixing system for the covering material of a window covering.

2. Description of the Prior Art

A conventional cordless roller shade includes a rotatable roller tube horizontally provided under a support. By rotating the roller tube, the covering material of the roller shade can be rolled up or released. A weight rod is provided below the covering material to be easily grasped and to add weights. The covering material can be expanded by simply pulling down the weight rod. Furthermore, once the downward pulling force is dismissed at any position during the lifting or lowering, a braking mechanism of the roller shade will be immediately activated, which overcomes the rewinding force generated by a spring mechanism hidden inside the roller tube, so that the covering material can remain in an unmoving limited state. If the user wants to roll up the covering material, he or she has to pull the weight rod downward first to dispel the limited state secured by the braking mechanism, and then let go the weight rod, letting the rewinding force of the spring mechanism take over, whereby drives the roller tube to automatically roll up the covering material.

To ensure sufficient rewinding force, it is common for conventional roller shades to use prestressed springs with high elasticity. However, applying such prestressed springs indirectly increases the manufacturing cost. In addition, while rolling up a conventional roller shade, the user usually has to pull down the weight rod first, or the limited state secured by the braking mechanism cannot be dispelled. This kind of operation is inconvenient for roller shades mounted inside window frames, for the weight rod of such a roller shade would be very close to the bottom margin of the window frame when the covering material is fully expanded.

SUMMARY OF THE INVENTION

In view of the above, one aspect of the present invention is to provide a position-fixing system which could be applied to various kinds of window coverings. The position-fixing system provided in the present invention could be easily operated and would be able to fix the position of the covering material promptly with high reliability.

The present invention provides a position-fixing system for a window covering, wherein the window covering has a covering material, a roller tube, and a support. The roller tube is pivotably connected to the support. The covering material has an end connected to the roller tube, and is adapted to be expanded from or wound around the roller tube. The position-fixing system includes a variable diameter screw, a guiding portion, and an elastic member. The variable diameter screw is fixedly connected to the support, wherein the variable diameter screw is defined to have an axis, and is defined to have a first end and a second end in an extension direction of the axis. The variable diameter screw has a working section, which gradually and radially broadens in a direction from the first end toward the second end. The guiding portion is connected to an inner wall of the roller tube, wherein the guiding portion extends in an axial direction of the roller tube. The elastic member fits around the variable diameter screw, wherein the elastic member is adapted to slide along the guiding portion. The elastic member has a meshing portion provided along an inner side thereof and a guided portion provided along an outer side thereof. At least a part of the meshing portion meshes with the working section of the variable diameter screw. The guided portion contacts the guiding portion, and is adapted to slide along the guiding portion. When the roller tube rotates in a first rotation direction, the elastic member moves along the working section of the variable diameter screw in a direction from the first end toward the second end, and the elastic member deforms correspondingly; as the elastic member deforms, the elastic member exerts a gradually increasing unit tightening force to the variable diameter screw in a radial direction of the variable diameter screw, whereby to dampen a rotation of the roller tube in the first rotation direction.

With the aforementioned design, when the roller tube rotates in a first rotation direction, the elastic member moves from the first end toward the second end along the working section of the variable diameter screw, and therefore deforms, whereby to increasingly exert a unit tightening force to the variable diameter screw in a radial direction thereof. In this way, the rotation of the roller tube in the first rotation direction would be hindered. In consideration of the change in the effective weight applied to the roller tube while the covering material is being rolled up or expanded, the working section which gradually broadens in the radial direction of the variable diameter screw is applied in the present invention, so that the unit tightening force exerted to the variable diameter screw could be changed during the rotation of the roller tube, and the change of the unit tightening force would correspond to the degree of expansion of the covering material, whereby to precisely fix the position thereof.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will be best understood by referring to the following detailed description of some illustrative embodiments in conjunction with the accompanying drawings, in which.

DETAILED DESCRIPTION

Figure 1:
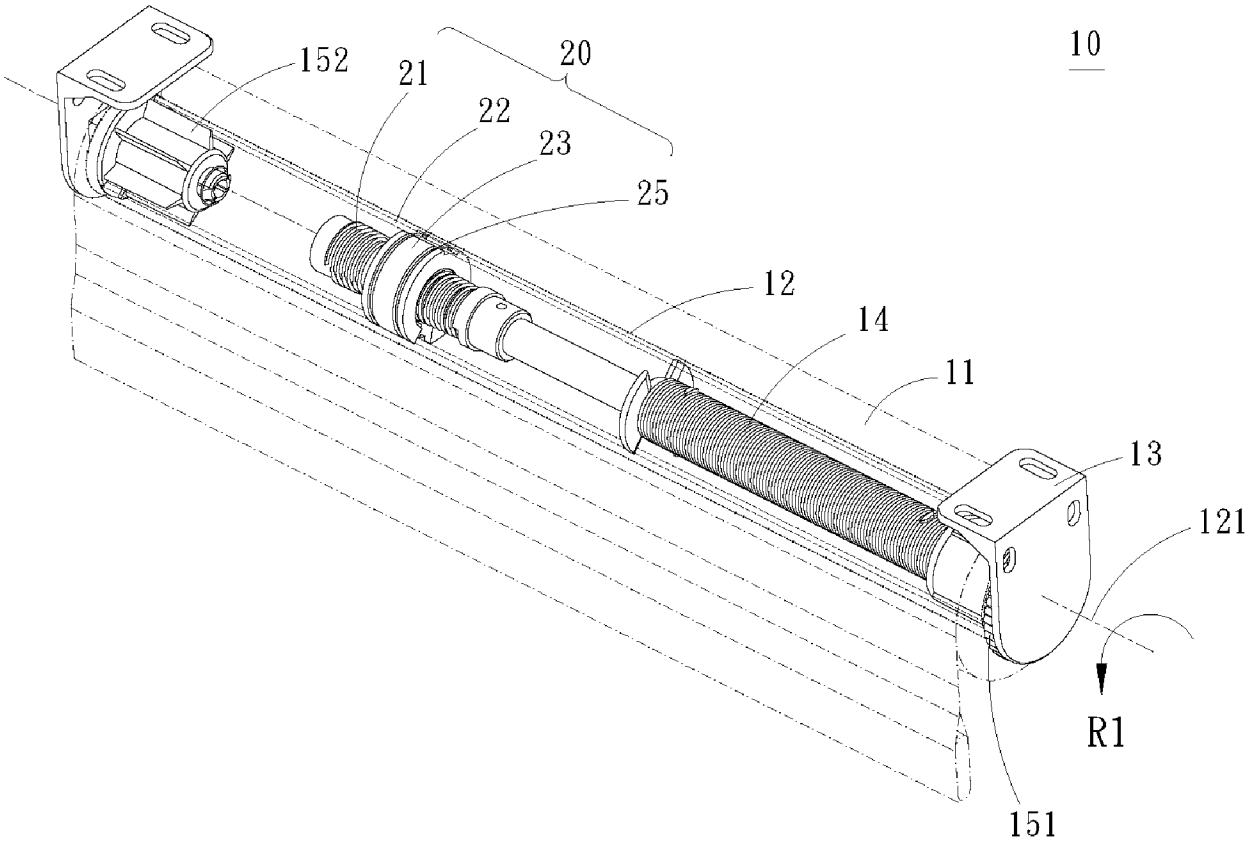
FIG. 1 is a perspective view of a roller shade, showing the covering material of the roller shade is rolled up.
Figure 2:
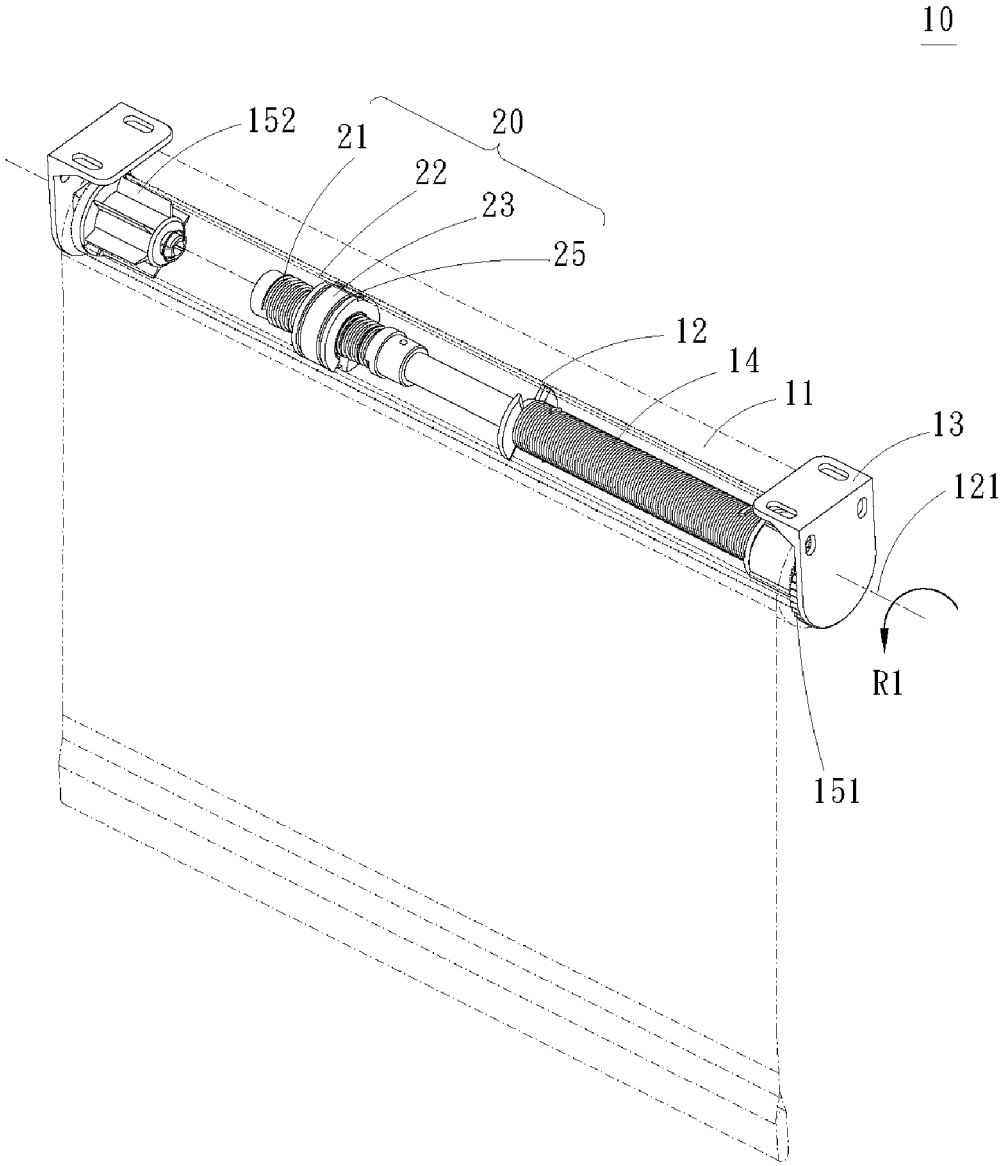
FIG. 2 is a perspective view of the roller shade, showing the covering material of the roller shade is lowered.
Figure 3:
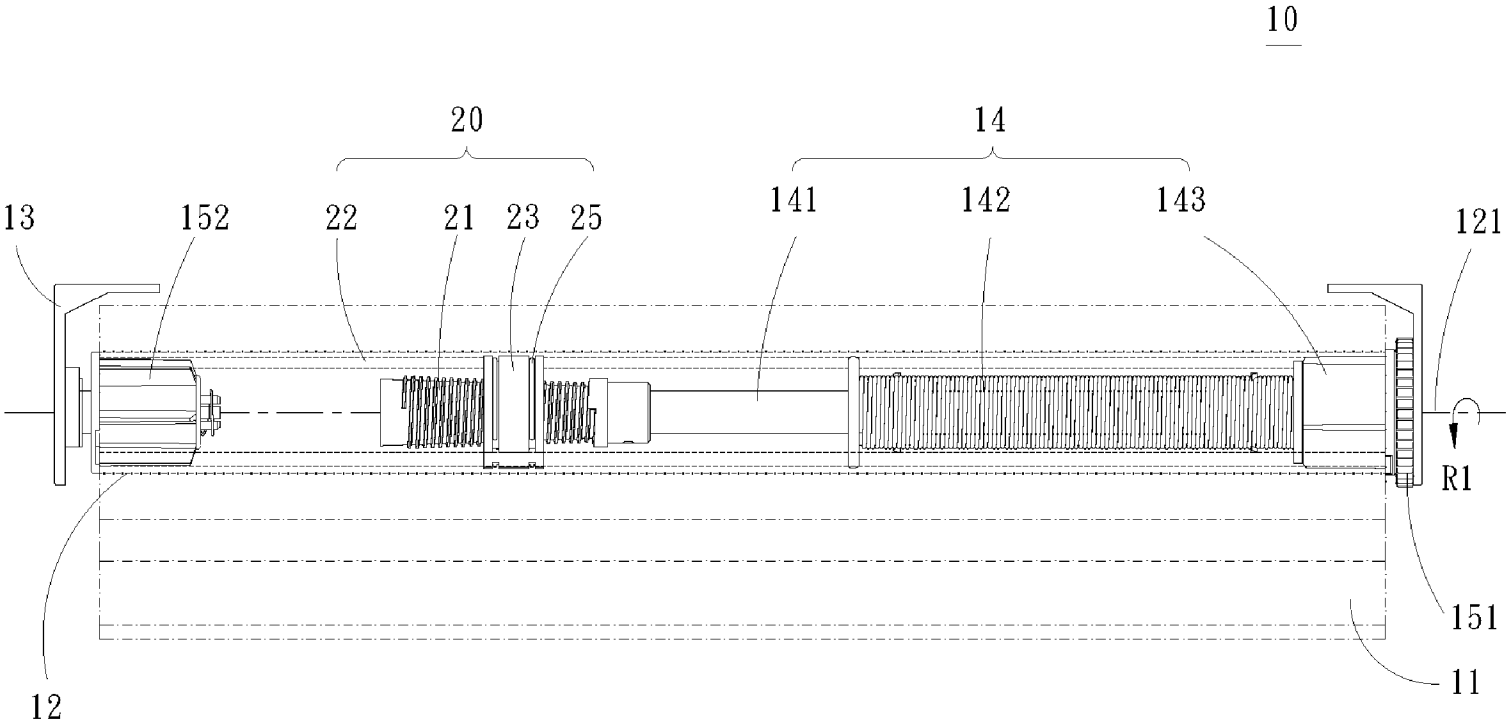
FIG. 3 is a front view of FIG. 1, showing the arrangement of a position-fixing system of the first embodiment of the present invention in the roller shade illustrated in FIG. 1.

FIG. 1 to FIG. 7 should be viewed together, wherein FIG. 1 and FIG. 2 are drawings of a roller shade applied with a position-fixing system of the present invention, and the roller shade is shown as completely rolled up and completely expanded in these two drawings, respectively. On the other hand, how a position-fixing system 20 of the first embodiment of the present invention arranged in the roller shade 10 is disclosed through FIG. 3 to FIG. 7. As shown in FIG. 1 to FIG. 3, the roller shade 10 includes a covering material 11, a roller tube 12, two supports 13, and a power mechanism 14, wherein one of the supports 13 is on one side, while the other one is on an opposite side, and the supports 13 are respectively fixed in a window frame or on a wall (not shown). The roller tube 12 passes through a first end plugging structure 151 and a second end plugging structure 152, respectively, and is pivotably connected to the supports 13. The power mechanism 14 is motivated concurrently while the roller tube 12 is driven. The power mechanism 14 has a connecting shaft 141 which is connected to at least one of the supports 13, a power spring 142 fitting around the connecting shaft 141, and a connecting sleeve 143, wherein the connecting sleeve 143 confines the movement of at least one end of the power spring 142, and is connected to the roller tube 12 to be coaxially rotated with the roller tube 12. An end of the covering material 11 is connected to the roller tube 12, while another end thereof droops by the weight of the covering material 11 itself, of a bottom rail (not shown), or of a weight rod (idem) provided. While pulling down or pushing up the covering material 11, the covering material 11 can be optionally expanded from the roller tube 12 or rolled up around the roller tube 12. Furthermore, the power spring 142 of the power mechanism 14 can store or release energy during the process of expanding or rolling up the covering material 11. The arrangement of the aforesaid roller shade 10 and the power mechanism 14 is a well-known technique, and is not a feature claimed in the present invention, so we are not going to describe it in further details.

Figure 4:
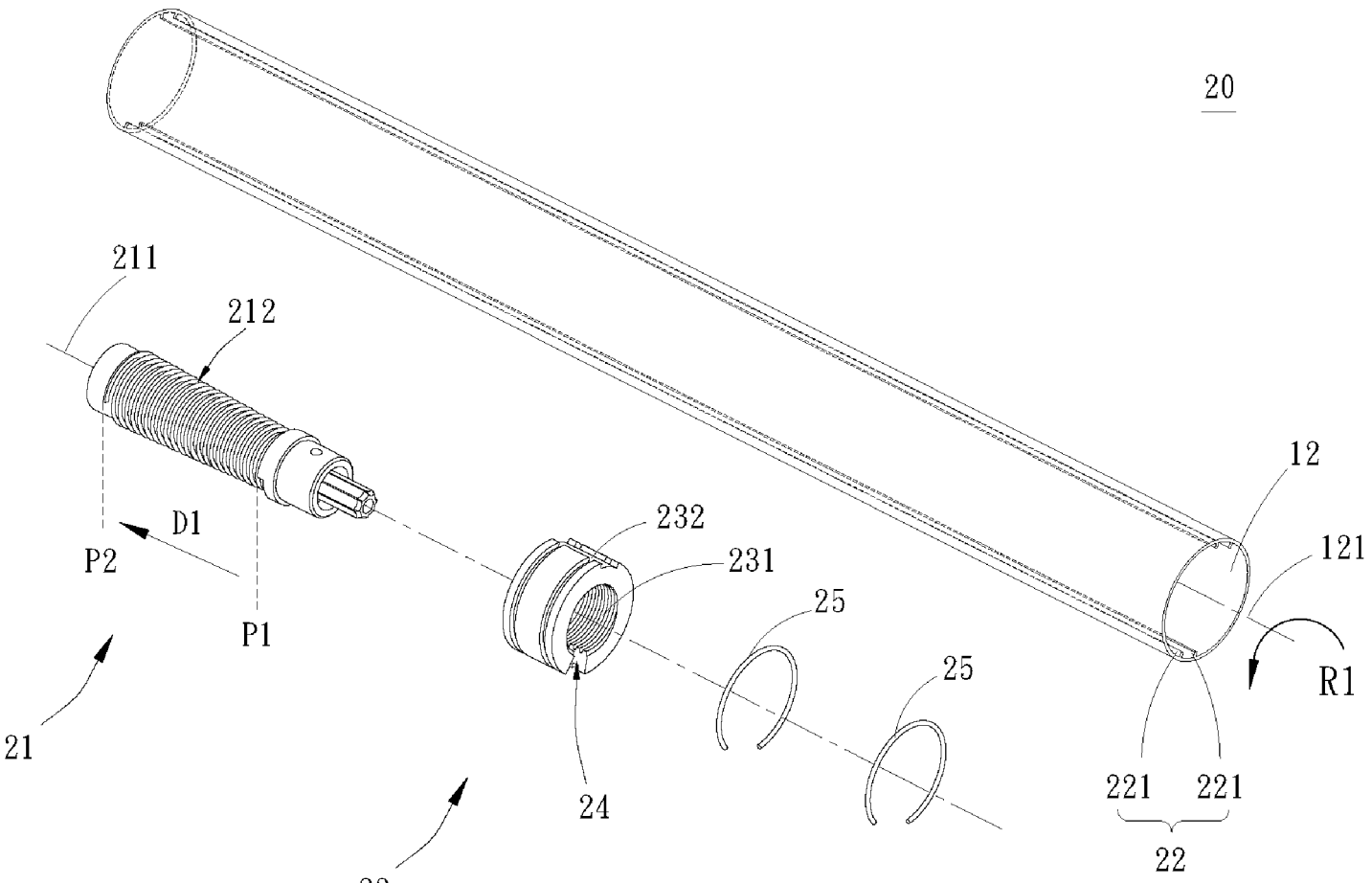
FIG. 4 is an exploded view of the position-fixing system of the first embodiment of the present invention.

The position-fixing system 20 of the current embodiment includes a variable diameter screw 21, a guiding portion 22, and an elastic member 23, as shown in FIG. 4. The position-fixing system 20 is mounted in the roller shade 10, and the variable diameter screw 21 is fixedly connected to at least one of the supports 13, which is implemented by fitting the variable diameter screw 21 around the connecting shaft 141 of the power mechanism 14 in the current embodiment. The variable diameter screw 21 is defined to have an axis 211, and a first end P1 and a second end P2 are respectively defined in an extension direction of the axis 211. Furthermore, the variable diameter screw 21 has a working section 212 which, in a direction from the first end P1 toward the second end P2, gradually increases a diameter thereof. For easier conveying of the concept of the present invention, herein we define that the direction from the first end P1 toward the second end P2 is a moving direction D1. The guiding portion 22 extends along an inner wall of the roller tube 12 in an axial direction 121 of the roller tube 12. The elastic member 23 fits around the variable diameter screw 21, and slides along the guiding portion 22. The elastic member 23 is defined to have an inner side and an outer side, and has a meshing portion 231 provided on the inner side thereof and a guided portion 232 provided on the outer side thereof. At least a part of the meshing portion 231 meshes with at least a part of the working section 212 of the variable diameter screw 21. The guided portion 232 of the elastic member 23 contacts the guiding portion 22 located at the roller tube 12, and is adapted to reciprocate in the axial direction 121 of the roller tube 12 due to the guiding of the guiding portion 22. The meshing portion 231 of the elastic member 23 could also crawl back and front along the axis 211 of the variable diameter screw 21 through the meshing with the working section 212 of the variable diameter screw 21.

Figure 5:
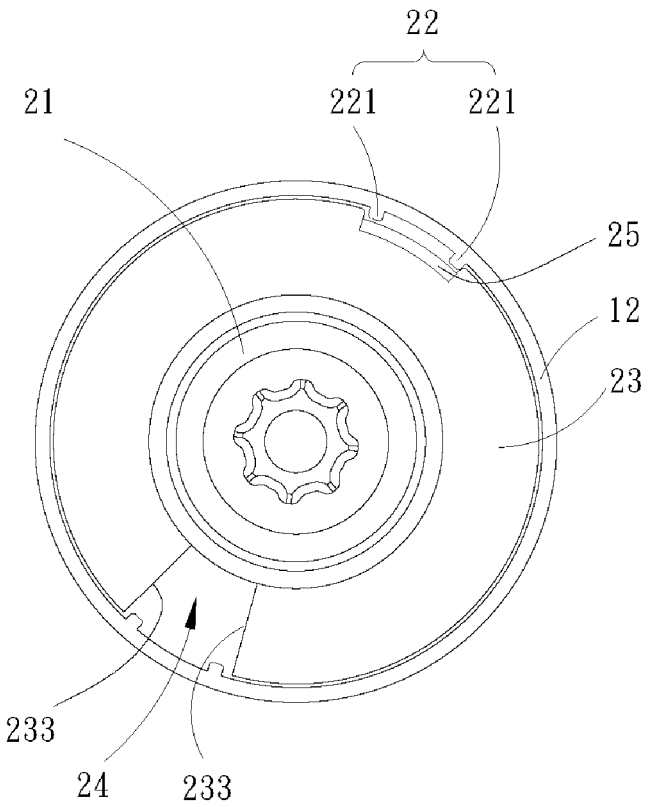
FIG. 5 is a side view of the position-fixing system of the first embodiment of the present invention.

In the current embodiment, the elastic member 23 is anon-closed elastic ring of a certain thickness, and is roughly round, as shown in FIG. 5. Therefore, the whole meshing portion 231 on the inner side of the elastic member 23 can mesh with a part of the working section 212 of the variable diameter screw 21.

Figure 6A:
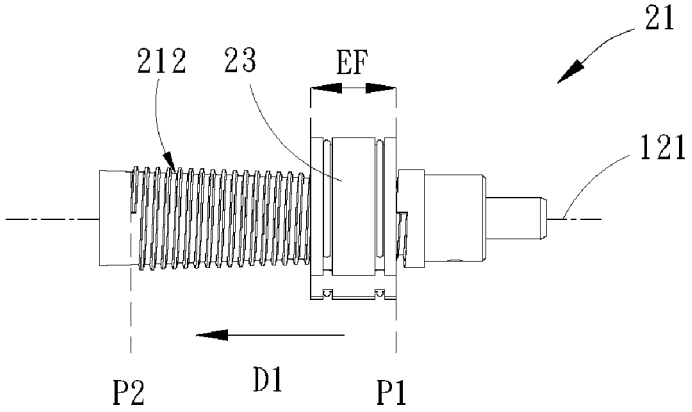
FIG. 6A to FIG. 6C are schematic views of the position-fixing system of the first embodiment of the present invention, showing how the elastic member therein crawls along a variable diameter screw, wherein an initial state of the position-fixing system is illustrated in FIG. 6A, while a terminal state of the position-fixing system is shown in FIG. 6C.
Figure 6B:
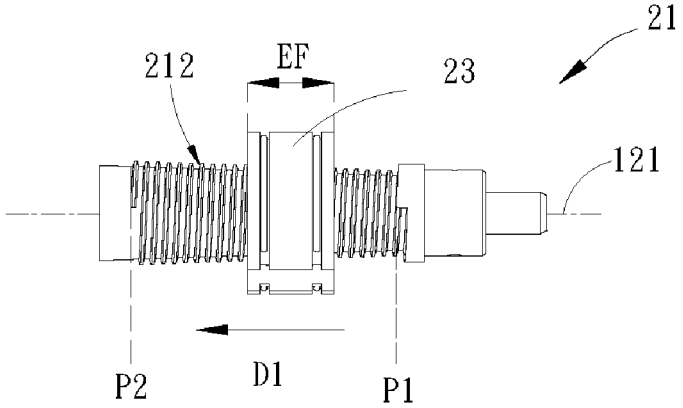
Figure 6C:
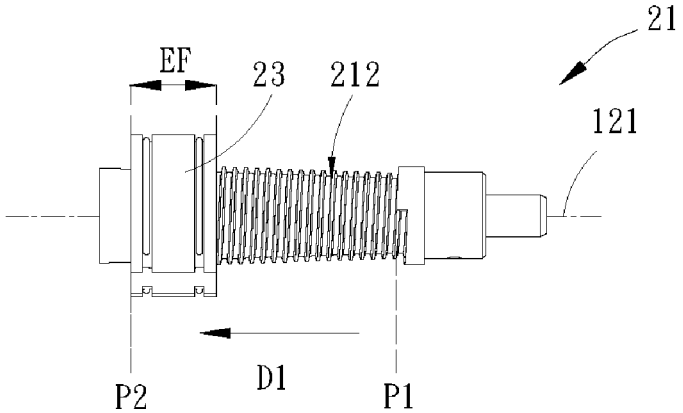
Figure 7:
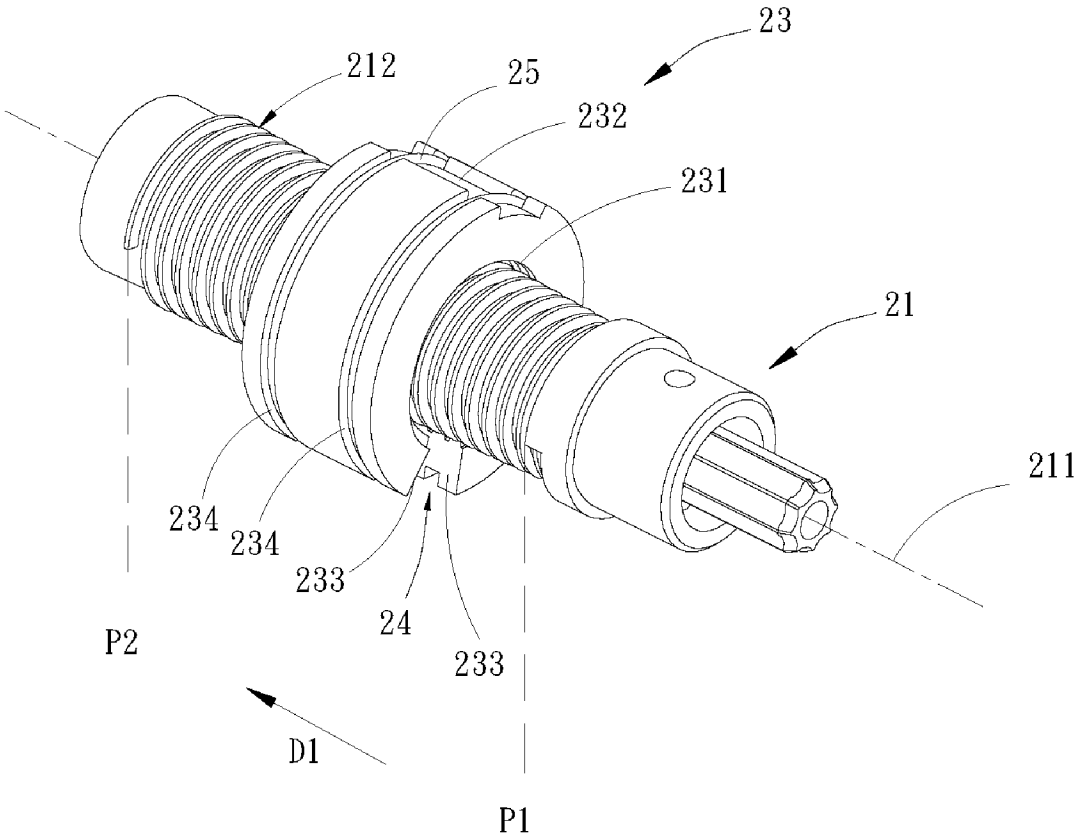
FIG. 7 is a perspective view of FIG. 6B.
Figure 18A:
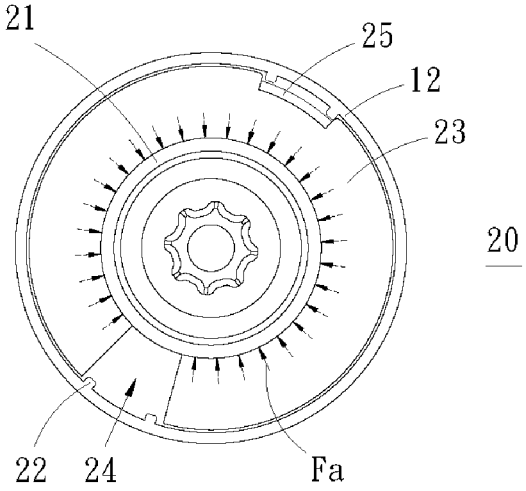
FIG. 18A to FIG. 18C are schematic views showing that, in the position-fixing system of each of the first embodiment to the third embodiment, the elastic member applies a unit tightening force to the variable diameter screw in a radial direction thereof.

When the roller tube 12 rotated in a first rotation direction R1, the elastic member 23 slides along the guiding portion 22 with the outer side thereof, and crawls along the working section 212 of the variable diameter screw 21 with the inner side thereof, whereby the elastic member 23 moves in the moving direction D1. The change of the elastic member 23 relative to the working section 212 of the variable diameter screw 21 is shown in FIG. 6A to FIG. 6C. Since the working section 212 of the variable diameter screw 21 gradually and radially broadens in the moving direction D1, the elastic member 23 fitting around the variable diameter screw 21 would correspondingly deform while it is being moved in the moving direction D1. Though how the elastic member 23 deforms depends on factors such as the thickness of the main body of the elastic member 23, Young's modulus of the material, and whether the material is integrally made, the requirement of the present invention can be still met as long as the stress caused by the deformation of the elastic member 23 could be concentratedly exerted to the working section 212 of the variable diameter screw 21, as shown in FIG. 7. Therefore, the elastic member 23 could apply a unit tightening force Fa to the working section 212 of the variable diameter screw 21 in the radial direction, wherein the unit tightening force Fa would gradually increase as the elastic member 23 is being moved in the moving direction D1. As shown in FIG. 18A, the unit tightening force Fa in the radial direction would correspondingly create friction on the variable diameter screw 21, so that said friction could hinder the roller tube 12 from rotating in the first rotation direction R1. Specifically, the unit tightening force Fa provided by the elastic member 23 to the variable diameter screw 21 is distributed along a meshed segment between the meshing portion 231 of the elastic member 23 and the working section 212 of the variable diameter screw 21.

In the current embodiment, the axial direction 121 of the roller tube 12 is collinear or in parallel with the axis 211 of the variable diameter screw 21.

As shown in FIG. 4, FIG. 5, and FIG. 7, the guiding portion 22 provided on the inner wall of the roller tube 12 has at least one rib 221. The guided portion 232 of the elastic member 23 is a groove corresponding to the aforesaid rib 221. The groove abuts against at least one side of the rib 221, and is adapted to slide along the rib 221. In short, the guiding portion 22 and the guided portion 232 have no interference with each other in the axial direction 121 of the roller tube 12, but have mutual interference in the first rotation direction R1 of the roller tube 12. When the roller tube 12 rotates in the first rotation direction R1, the elastic member 23 rotates along with the roller tube 12, and slides in the roller tube 12. The aforesaid guiding portion 22 can have two parallel ribs 221, or can have one single rib 221 which has the same width with the groove. However, no matter whether the guiding portion 22 only has one single rib 221 which is narrower than the groove, or the structures of the guiding portion 22 and the guided portion 232 interchanged, the guiding portion 22 would still not interference with the sliding of the guided portion 232 of the elastic member 23 in the axial direction 121 of the roller tube 12, but mutually interference with the movement in the first rotation direction R1 of the roller tube 12.

In addition, there can be more than one guiding portion 22 provided on the inner wall of the roller tube 12. In the current embodiment, there are two guiding portions 22 correspondingly provided on the upside and the downside of the inner wall of the roller tube 12. However, the number of the guiding portion 22 does not affect the provided effect.

The variable diameter screw 21 includes a screw body, wherein the screw body has threads provided on an outer surface thereof, as shown in FIG. 7. The radial increase of the working section 212 of the variable diameter screw 21 in the moving direction D1 can be implemented by at least two ways, one is to gradually increase a radius of the screw body in the moving direction D1, and the other is to gradually increase a depth of the threads in the moving direction D1. It does not matter whether it's one or both of these two ways are applied in an embodiment, as long as the working section 212 of the variable diameter screw 21 radially broadens in the moving direction D1.

As mentioned above, in the current embodiment, the elastic member 23 is a non-closed elastic ring of a certain thickness. Herein we define a side of the elastic member 23 facing the variable diameter screw 21 is an inner side, and another side thereof facing the roller tube 12 is an outer side. The meshing portion 231 is provided on the inner side of the non-closed elastic ring, and the guided portion 232 is provided on the outer side of the non-closed elastic ring. Furthermore, the meshing portion 231 has threads appropriately matching the threads of the variable diameter screw 21, so that the meshing portion 231 of the non-closed elastic ring can mesh with the working section 212 of the variable diameter screw 21.

It is worth mentioning that, the working section 212 defined in the present invention refers to a segment on the variable diameter screw 21 which provides a mechanical advantage in the moving of the elastic member 23. In the current embodiment, it is represented by the points of application of force on the variable diameter screw 21 which drive the elastic member 23 to crawl. The working section 212 can be constituted by crests, troughs, and walls of the threads, and alternatively, can be constituted merely by at least part of the crests of the threads, merely by at least part of the troughs of the threads, or merely be at least a part of the walls of the threads. Whether the working section 212 of the variable diameter screw 21 is constituted by the crests or troughs or walls of the threads depends on the structures of the corresponding elastic member 23 itself and the meshing portion 231 thereof.

It is worth mentioning that, in the present invention, the meshing between at least a part of the meshing portion 231 and at least apart of the working section 212 of the variable diameter screw 21 is defined as an effective meshing segment EF. As mentioned above, the effective meshing segment EF in the current embodiment is the meshing between the whole meshing portion 231 on the inner side of the elastic member 23 and the corresponding part of the working section 212 of the variable diameter screw 21.

The position-fixing system 20 further includes a space 24, which is provided inside the roller tube 12, and is adjacent to the elastic member 23. The space 24 allows the elastic member 23 to deform. In the current embodiment, the elastic member 23 has two ends 233 provided in a circumferential direction thereof, whereby to form a non-closed elastic ring. The space 24 is located at the two ends of the non-closed elastic ring. With such design, when the elastic member 23 moves along the variable diameter screw 21 in the moving direction D1, the main body of the elastic member 23 deforms toward the two ends 233, and the ample space 24 reduces in the radial direction of the working section 212.

The elastic member 23 can be integrally made of silicone or rubber. To further concentrate the stress created by the deformation of the elastic member 23 onto the working section 212 of the variable diameter screw 21, and to prevent the guiding portion 22 from interfering with the sliding of the guided portion 232 of the elastic member 23 in the axial direction 121 of the roller tube 12, the position-fixing system 20 further includes at least a non-closed rigid ring 25, which fits in at least one circumferential groove 234 of the elastic member 23 to provide an inward holding force to the elastic member 23 which deforms as a whole. It is worth mentioning that, even if the elastic member 23 is integrally made of silicon or rubber materials, its thickness and Young's modulus could be also adjusted to provide the effect of preventing the guiding portion 22 from interfering with the sliding of the guided portion 232 of the elastic member 23 in the axial direction 121 of the roller tube 12.

In addition, the non-closed rigid ring 25 also passes through the guided portion 232 of the elastic member 23, i.e., where the groove is. Similarly, the non-closed rigid ring 25 does not affect the technical effect that the guiding portion 22 does not interfere with the sliding of the guided portion 232 of the elastic member 23 in the axial direction 121 of the roller tube 12, but mutually interfere with the guided portion 232 in the first rotation direction R1 of the roller tube 12.

As shown in FIG. 6A to FIG. 6C, the variable diameter screw 21 is provided with two restricting structures at the first end P1 and the second end P2, respectively, so that the effective meshing segment EF between the meshing portion 231 of the elastic member 23 and the working section 212 of the variable diameter screw 21 can be ensured unchanged, whereby to make sure the elastic member 23 only deforms at the same segment thereof. In this way, the change of the unit tightening force Fa exerted by the elastic member 23 to the variable diameter screw 21 can be precisely controlled. However, even if the variable diameter screw 21 does not have restricting structures provided at the first end P1 and the second end P2, the technical effect that the elastic member 23 is adapted to create the gradually increasing unit tightening force Fa to the variable diameter screw 21 would not be affected.

The arrangement of a position-fixing system 30 of a second embodiment of the present invention in the roller shade 10 is shown in FIG. 8 to FIG. 11.

Figure 8:
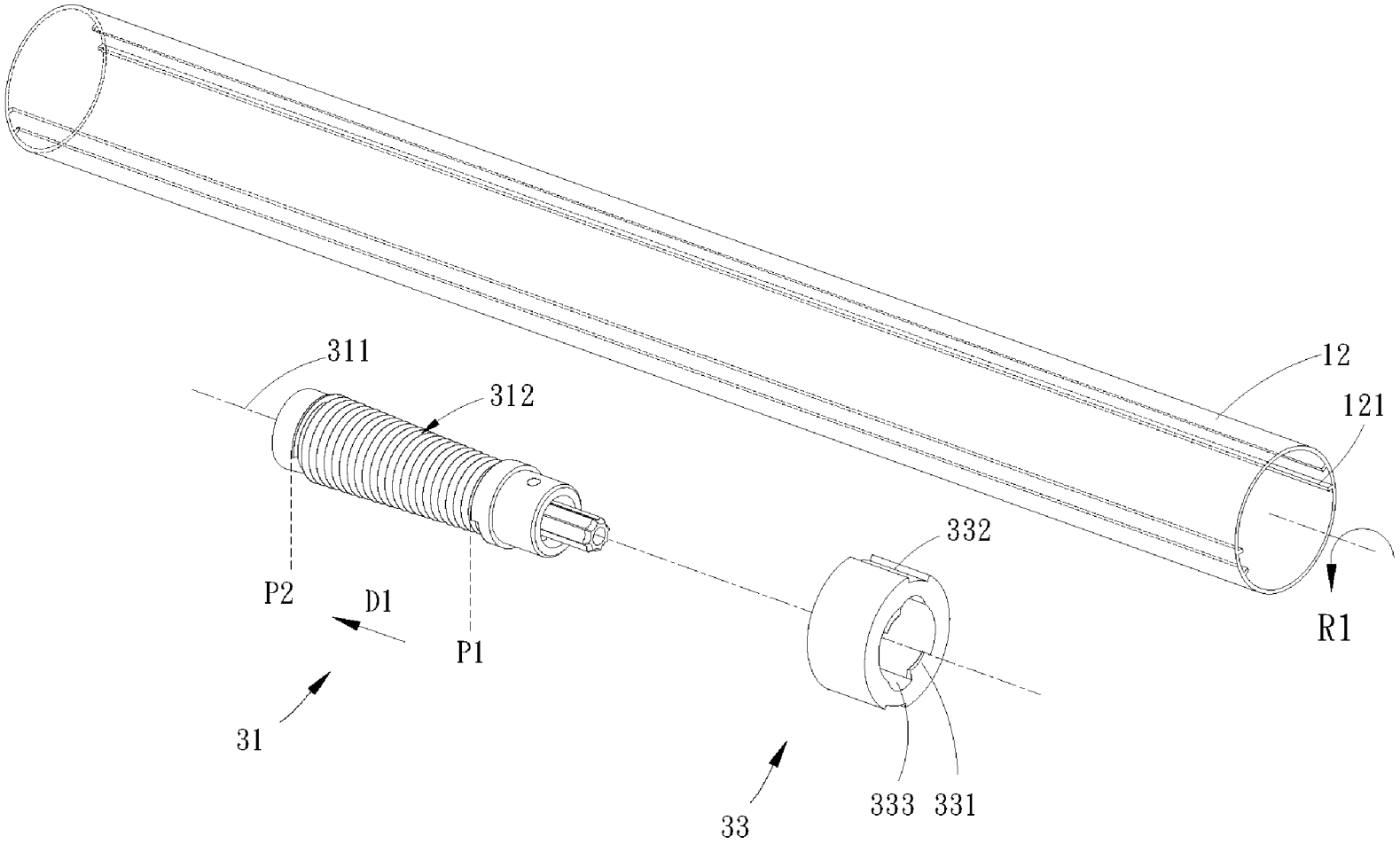
FIG. 8 is an exploded view of a position-fixing system of the second embodiment of the present invention.

The position-fixing system 30 of the current embodiment includes a variable diameter screw 31, a guiding portion 32, and an elastic member 33, as shown in FIG. 8, wherein the structures, arrangements, ways of changing, and the technical effects of the variable diameter screw 31 and the guiding portion 32 of the position-fixing system 30 are roughly the same with those described in the first embodiment. The variable diameter screw 31 includes a screw body, and the screw body has threads provided on an outer wall thereof. In addition, the variable diameter screw 31 is defined to have an axis 311, which has a defined first end P1 and a defined second end P2 in an extension direction of the axis 311. The variable diameter screw 31 has a working section 312, which gradually broadens from the first end P1 to the second end P2 in a radial direction of the variable diameter. The guiding portion 32 extends along the inner wall of the roller tube 12 in the axial direction 121 of the roller tube 12. In the current embodiment, the number of the guiding portions 32 is two as an example, wherein each of the guiding portions 32 includes two parallel ribs 321.

Figure 9:
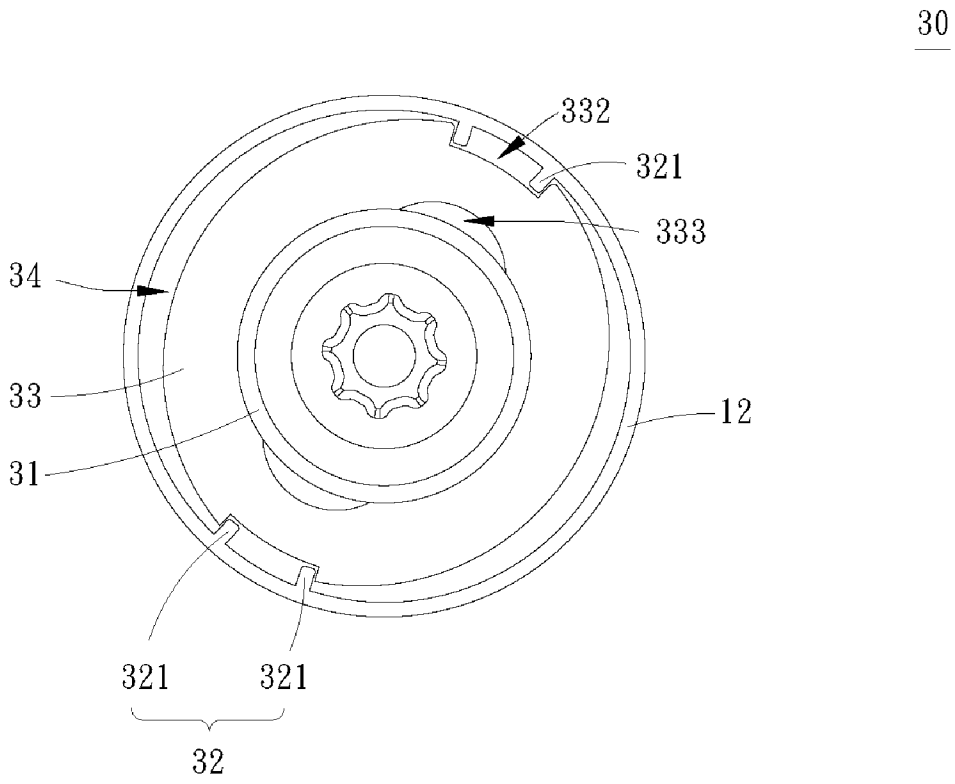
FIG. 9 is a side view of the position-fixing system of the second embodiment of the present invention.
Figure 10:
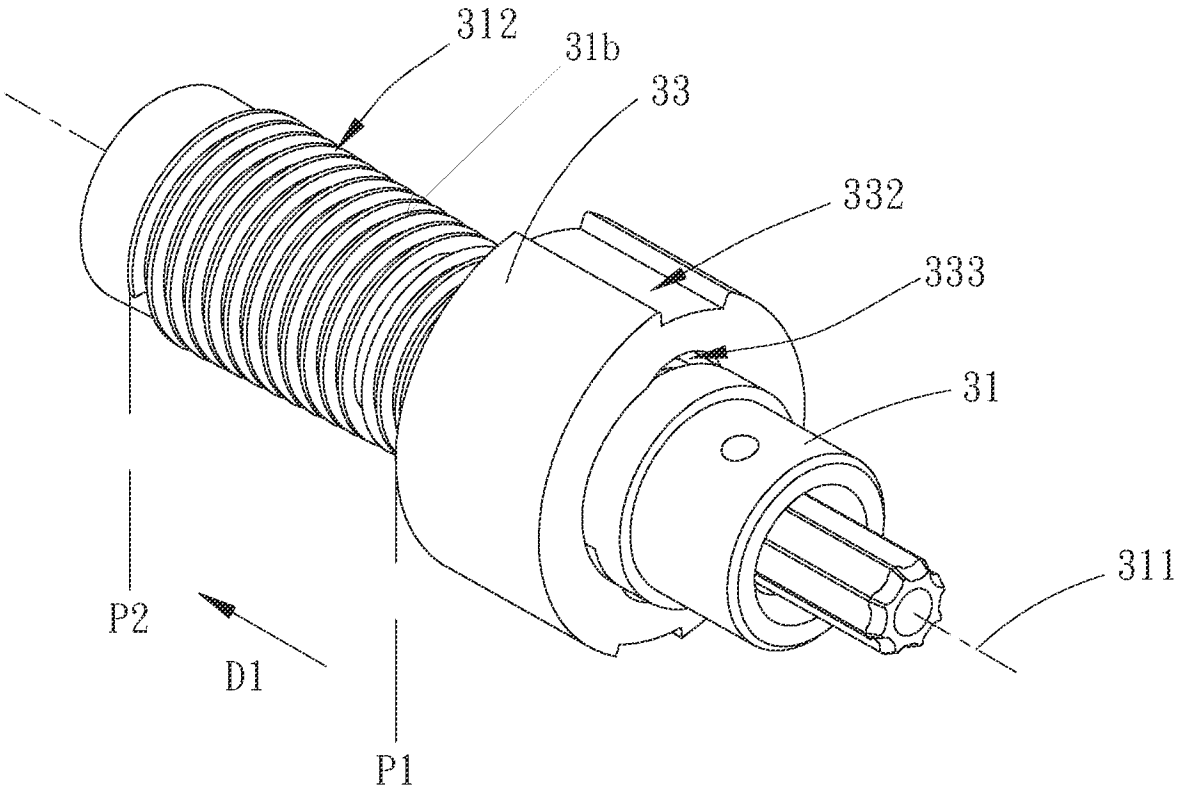
FIG. 10 is a perspective view showing that the elastic member in the second embodiment of the present invention is engaged with a variable diameter screw.

As shown in FIG. 9 and FIG. 10, the elastic member 33 is an enclosed elastic ring of a certain thickness, and is slightly elliptical. A side of the elastic member 33 facing the variable diameter screw 31 is defined as an inner side, and another side thereof facing the roller tube 12 is defined as an outer side. The elastic member 33 has a meshing portion 331 provided on the inner side thereof, and a guided portion 332 provided on the outer side thereof. The elastic member 33 is defined to have two sides in an axial direction thereof. The meshing portion 331 of the elastic member 33 includes a plurality of teeth, which mutually mesh with at least a part of the working section 312 of the variable diameter screw 31, forming the effective meshing segment EF of the current embodiment. However, in the current embodiment, the meshing portion 331 of the elastic member 33 can also be threads, as the meshing portion 231 of the elastic member 23 in the first embodiment, which would not affect the technical effect that the elastic member 23 can be moved in the moving direction D1.

Figure 11B:
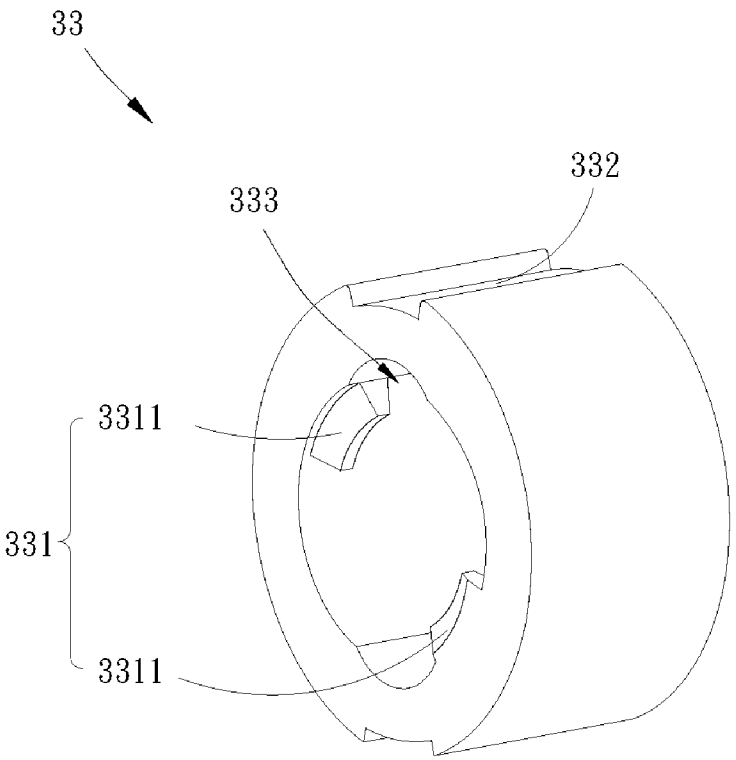
FIG. 11B is also a perspective view of the elastic member in the second embodiment of the present invention seen from another angle.
Figure 11A:
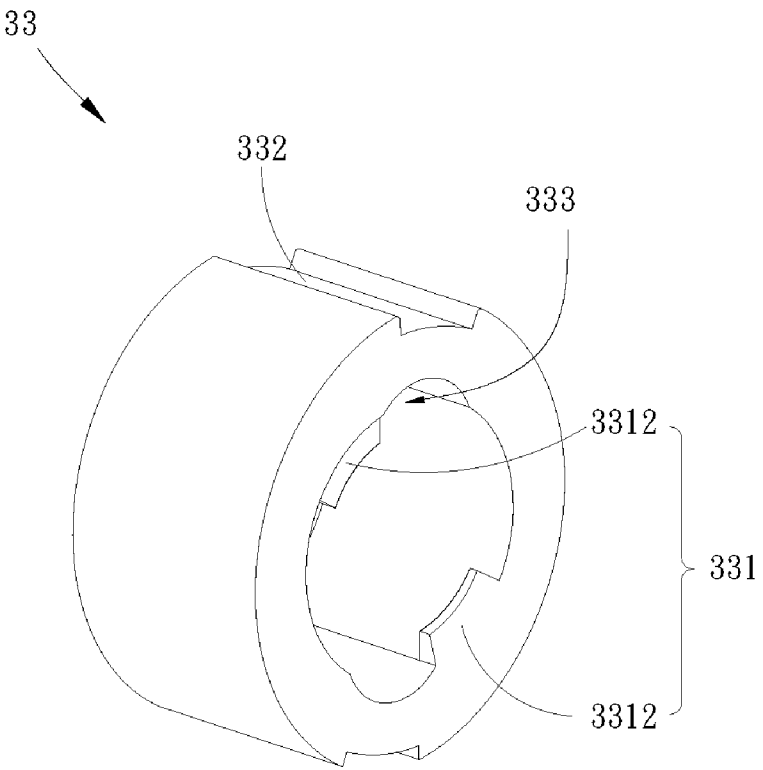
FIG. 11A is a perspective view of the elastic member in the second embodiment of the present invention.
Figure 12:
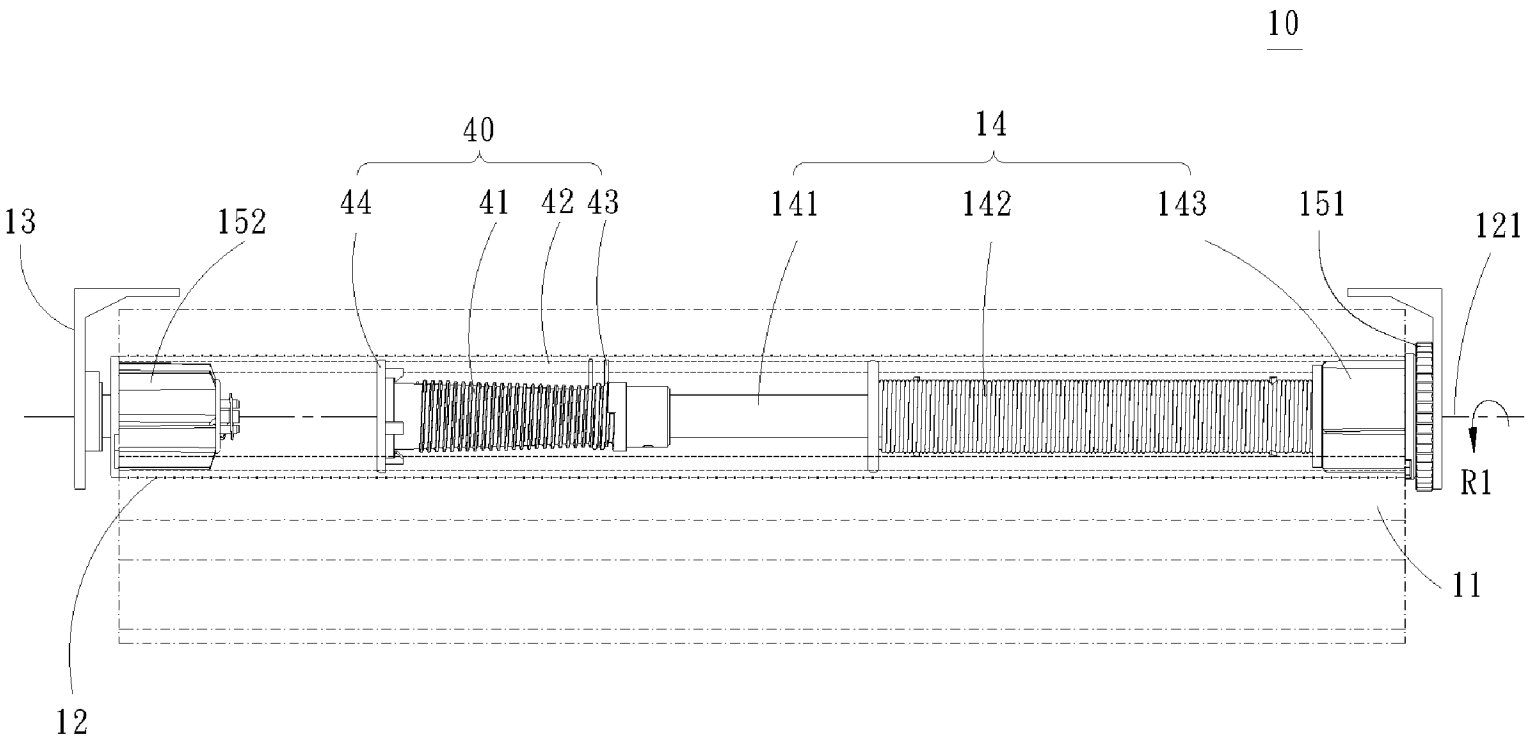
FIG. 12 is a front view of a roller shade, showing the arrangement of a position-fixing system of the third embodiment of the present invention in the roller shade.

As shown in FIG. 11A and FIG. 11B, the current embodiment has two symmetrical teeth 3311, 3312, each of which is located on one of the two sides of the elastic member 33, respectively. Furthermore, each pair of teeth 3311, 3312 is provided on the inner side of the elastic member 33 in a paired and symmetrical manner. Each of the teeth 3311, 3312 are separated in a circumferential direction on the inner side of the elastic member 33. However, even if there is only one tooth forming the meshing portion 331 of the elastic member 33, it would not affect the technical effect that the meshing portion 331 mutually meshes with threads 31*b* in the working section 312 of the variable diameter screw 31.

As shown in FIG. 9, the elastic member 33, which is an enclosed elastic ring, has a curved groove 333 provided on the inner side thereof. The curved groove 333 and the guided portion 332 are provided on a same radial direction r of the variable diameter screw 31, wherein the curved groove 333 is provided to prevent the elastic member 33 from deforming in a direction toward the guided portion 332 when applied with force provided by the contact of the variable diameter screw 31. In this way, the guiding portion 32 is prevented from interfering with the sliding of the guided portion 332 of the elastic member 33 in the axial direction 121 of the roller tube 12.

In addition, there can be more than one curved groove 333 provided on the inner side of the elastic member 33. In the current embodiment, there are two curved grooves 333 symmetrically provided on the inner side of the elastic member 33, wherein one is on the upside and the other is on the downside. However, the number of the curved grooves 333 does not affect the provided technical effect.

Besides, when it comes to the arrangement of the aforesaid teeth 3311, 3312 on the inner side of the elastic member 33 in the circumferential direction, the deformation of the elastic member 33 can be guided to directions other than the radial direction r by not providing them in the same radial direction r with the curved grooves 333.

It is worth mentioning that, whether the elastic member 33 has the curved groove 333 provided or not, and no matter how the curved groove 333 and the teeth 3311, 3312 are staggered in the circumferential direction of the elastic member 33, it is possible for the elastic member 33 to provide its required function merely by the material of itself.

The elastic member 33 can be integrally made of silicone or rubber. The position-fixing system 30 further includes a space 34, which is inside the roller tube 12 and is adjacent to the elastic member 33. In the current embodiment, the space 34 is located between the slightly elliptical elastic member 33 and the roller tube 12. Therefore, when the elastic member 33 is moved along the variable diameter screw 31 in the moving direction D1, the main body of the elastic member 33 deforms in a direction toward the inner wall of the roller tube 12, and the space 34 reduces as the working section 312 increases in the radial direction thereof.

Figure 18B:
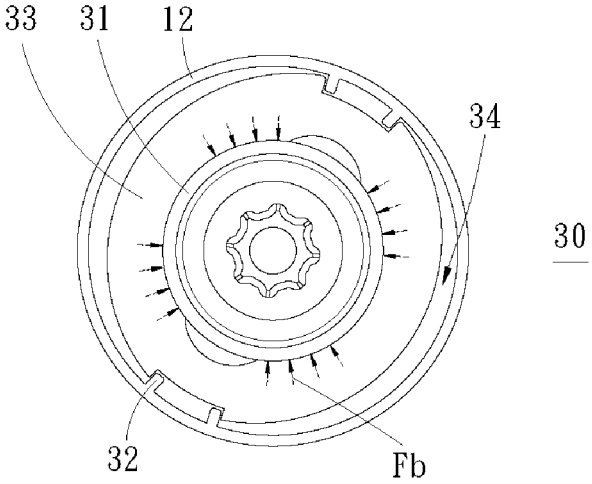

Therefore, the elastic member 33 radially exerts a gradually increasing unit tightening force Fb to the working section 312 of the variable diameter screw 31 in the moving direction D1, as shown in FIG. 18B. The unit tightening force Fb applied in the radial direction would correspondingly create friction on the variable diameter screw 31. In this way, said friction could hinder the rotation of the roller tube 12 in the first rotation direction R1, as shown in FIG.

10. The unit tightening force Fb exerted by the elastic member 33 to the variable diameter screw 31 is distributed along a meshing segment between the meshing portion 331 of the elastic member 33 and the working section 312 of the variable diameter screw 31.

The arrangement of the roller shade 10 applied with a position-fixing system 40 of the third embodiment of the present invention is shown in FIG. 12 to FIG. 17C.

Figure 13:
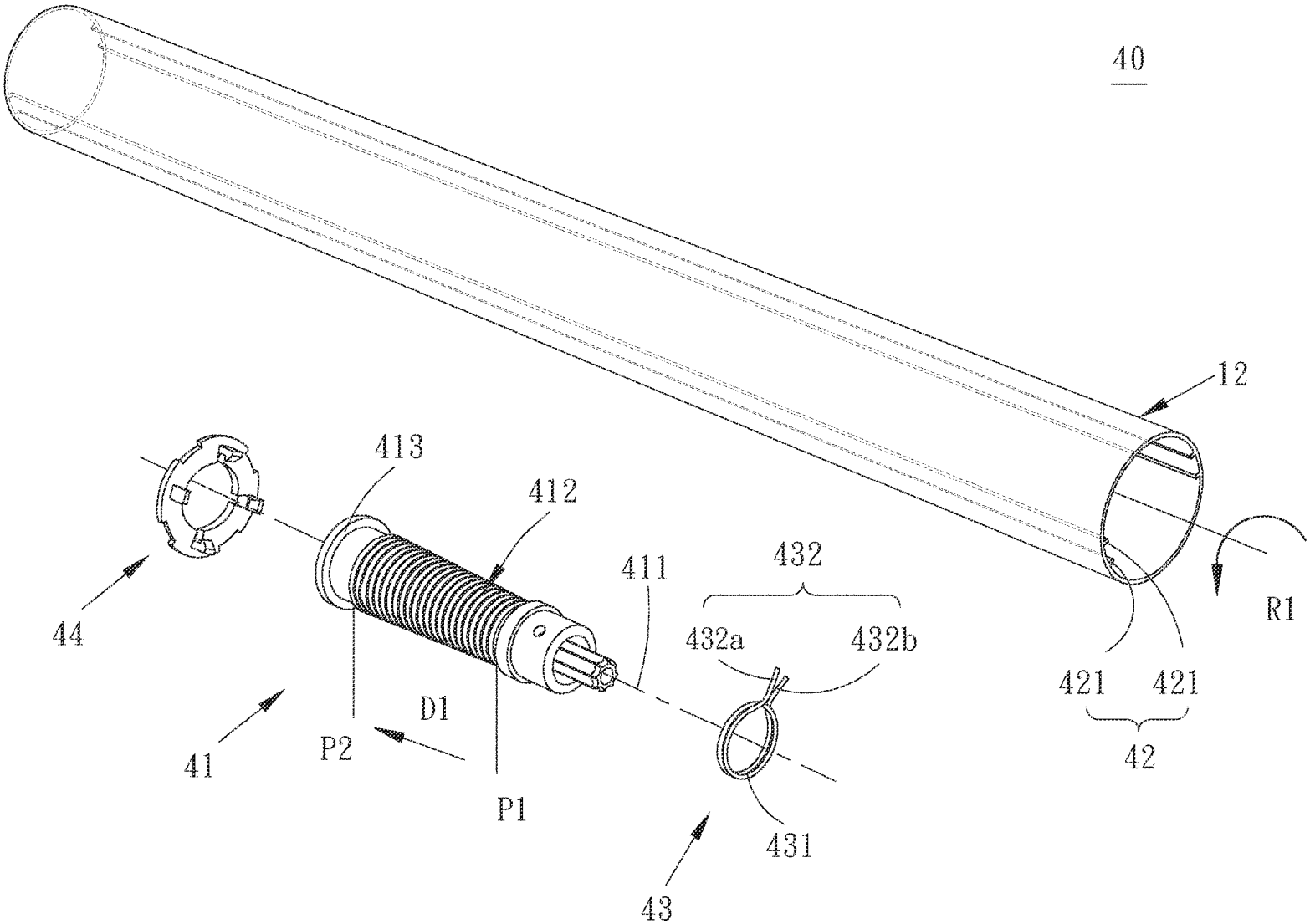
FIG. 13 is an exploded view of the position-fixing system of the third embodiment of the present invention.

In the current embodiment, the position-fixing system 40 includes a variable diameter screw 41, at least one guiding portion 42, and an elastic member 43, as shown in FIG. 13. The structures, arrangements, ways of changing, and the technical effects of the variable diameter screw 41 and the guiding portion 42 of the position-fixing system 40 are roughly the same with those disclosed in the first embodiment. The variable diameter screw 41 includes a screw body, and the screw body has threads provided on an outer wall thereof. The variable diameter screw 41 is further defined to have an axis 411, wherein a first end P1 and a second end P2 are respectively defined in an extension direction of the axis 411. The variable diameter screw 41 has a working section 412, which gradually and radially broadens in a direction from the first end P1 toward the second end P2. The guiding portion 42 extends along the inner wall of the roller tube 12 in the axial direction 121 of the roller tube 12. In the current embodiment, there are two guiding portions 42 as an example, each of which includes two parallel ribs 421.

Figure 14:
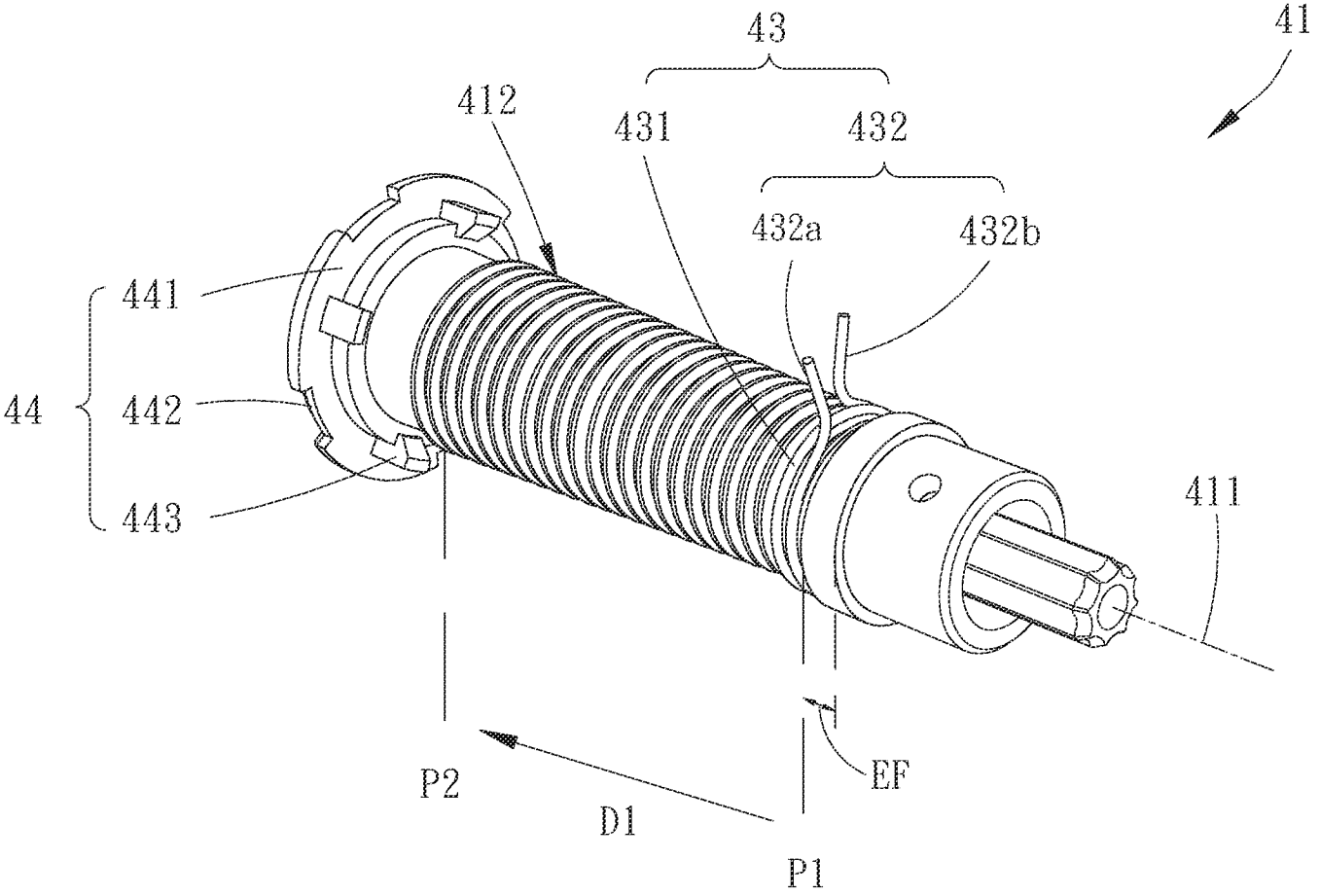
FIG. 14 is a perspective view showing that the elastic member in the third embodiment is engaged with a variable diameter screw.

As shown in FIG. 13 and FIG. 14, the elastic member 43 is a tightening spring, of which a side facing the variable diameter screw 41 is defined as an inner side, and another side facing the roller tube 12 is defined as an outer side. The elastic member 43 has a meshing portion 431 provided along the inner side thereof, and a guided portion 432 provided along the outer side thereof. In the current embodiment, the elastic member 43, which is a tightening spring as an example, includes a main body forming the meshing portion, and two ends 432*a*, 432*b* forming the guided portion 432. The main body of the tightening spring includes at least one round of spring coil, wherein the spring coil mutually meshes with at least a part of the working section 412 of the variable diameter screw 41, forming an effective meshing segment EF of the current embodiment.

A distance between the two ends 432*a*, 432*b* of the tightening spring is at least greater than a width between the parallel ribs 421 of each of the guiding portions 42. Both the ends 432*a*, 432*b* of the tightening spring abut against one side of the corresponding guiding portion 42, whereby the tightening spring is adapted to slide along the corresponding guiding portion 42.

Please refer to FIG. 16A to 16C, and FIG. 17A to 17C.

In the current embodiment, when the elastic member 43 is moved in the moving direction D1, the end 432*a* of the tightening spring always abuts against one side of one of the ribs 421 of the corresponding guiding portion 42, and the tightening spring slides along said rib 421. On the other hand, the other end 432*b* of the tightening spring can be moved freely in the circumferential direction of the variable diameter screw 41, for the working section 412 of the variable diameter screw 41 gradually broadens in the radial direction thereof.

Figure 18C:
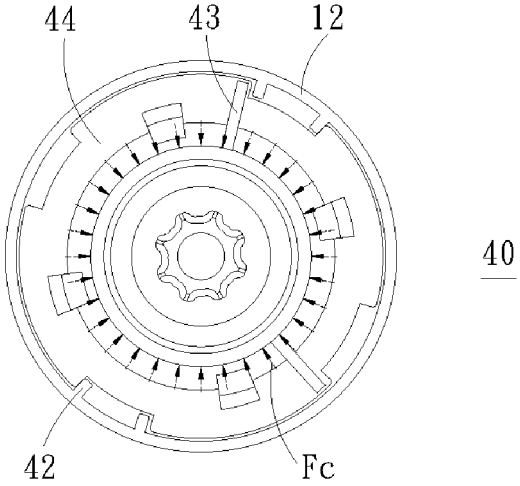

Therefore, the elastic member 43 exerts a gradually increasing unit tightening force Fc to the working section 412 of the variable diameter screw 41 in the radial direction thereof, as shown in FIG. 18C. The unit tightening force Fc in the radial direction would correspondingly create friction on the variable diameter screw 41, whereby said friction could hinder the rotation of the roller tube 12 in the first rotation direction R1. The unit tightening force Fc is distributed along a meshing segment between the spring coil (i.e., the meshing portion 431) of the tightening spring (i.e., the elastic member 43) and the working section 412 of the variable diameter screw 41.

Figure 15B:
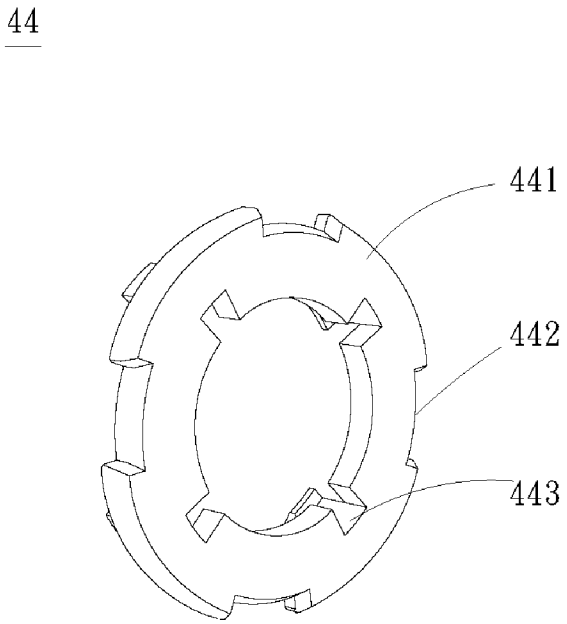
FIG. 15B is also a perspective view of the support disc of the third embodiment of the present invention seen from another side thereof.
Figure 15A:
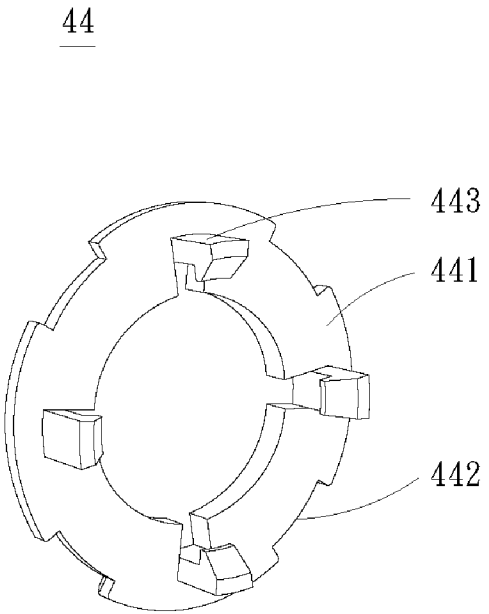
FIG. 15A is a perspective view of the support disc of the third embodiment of the present invention seen from a side thereof.
Figure 16A:
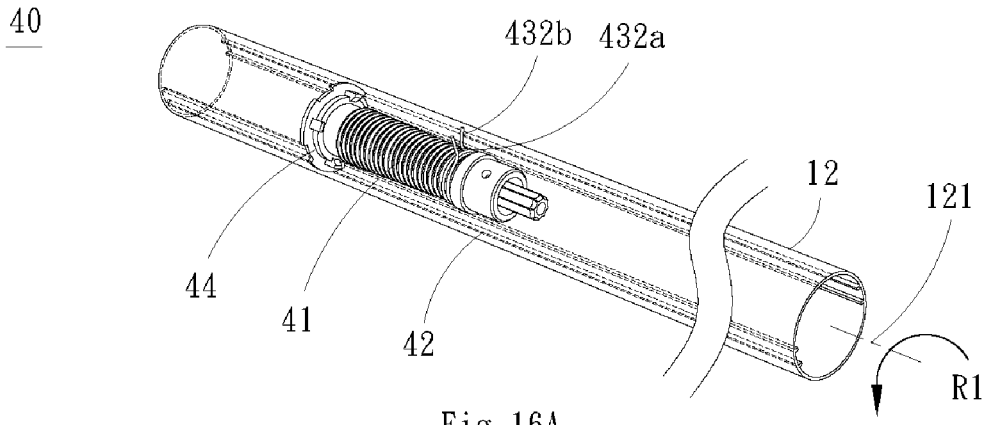
FIG. 16A to FIG. 16C are perspective views of the position-fixing system of the third embodiment of the present invention, showing how the elastic member therein crawls along a variable diameter screw, wherein an initial state of the position-fixing system is illustrated in FIG. 16A, while a terminal state of the position-fixing system is shown in FIG. 16C.
Figure 16B:
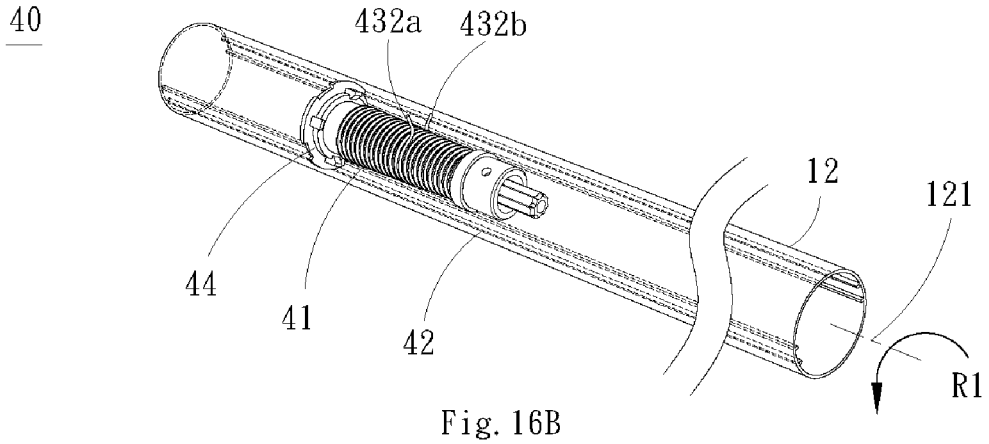
Figure 16C:
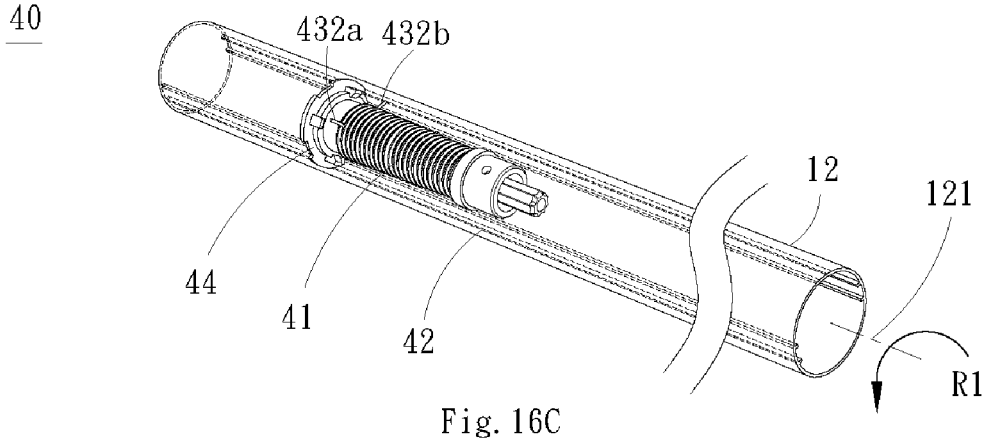
Figure 17A:
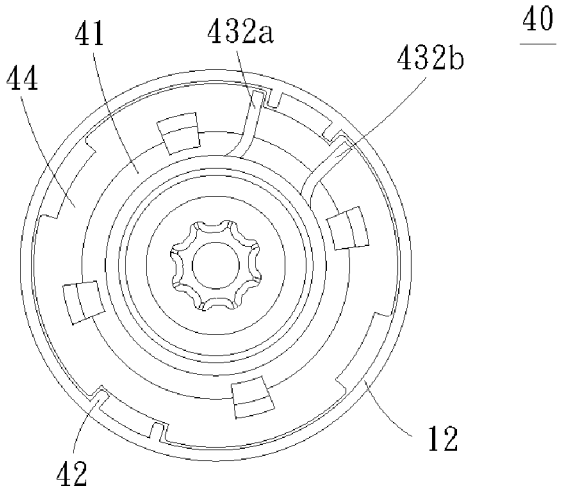
FIG. 17A to FIG. 17C are side views of the position-fixing system of the third embodiment of the present invention, showing how the elastic member therein keeps crawling along a variable diameter screw in a roller tube, wherein an initial state of the position-fixing system is illustrated in FIG. 17A, an intermediate state of the position-fixing system is shown in FIG. 17B, and a terminal state of the position-fixing system is shown in FIG. 17C.
Figure 17B:
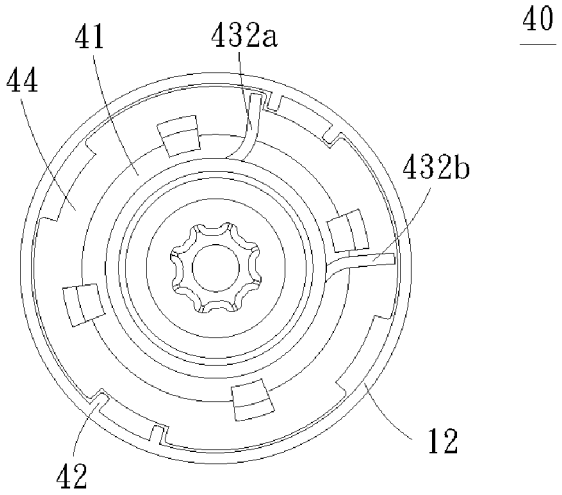
Figure 17C:
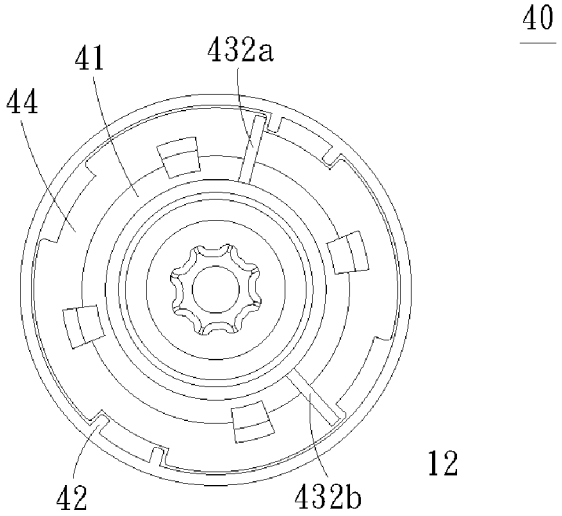

Please refer to FIG. 13, FIG. 14, FIG. 15A, and FIG. 15B. In the current embodiment, the variable diameter screw 41 has two ends in the axial direction 411, wherein a rim 413 is extended in a radial direction at the end near the second end P2. The position-fixing system 40 further includes a support disc 44 which holds the rim 413 in a snap-fitting way, so that the support disc 44 is connected to and rotatable relative to the variable diameter screw 41, as shown in FIG. 13. The support disc 44 is adapted to slide along the inner wall of the roller tube 12, and is adapted to coaxially rotate with the roller tube 12, as shown in FIG. 14. Specifically, the support disc has a disc body 441, an insert groove 442 recessed into a circumference of the disc body 441, and a holding portion 443 extending from the disc body 441 toward the working section 412 of the variable diameter screw 41, as shown in FIG. 15A and FIG. 15B.

With the aforementioned design, the insert groove 442 matches the guiding portion 42 of the roller tube 12 (i.e., the parallel ribs 421), and therefore the disc body 441 is adapted to slide in the roller tube 12 along the ribs 421. The holding portion 443 of the support disc 44 holds the rim 413 of the variable diameter screw 41 in a snap-fitting way, so that the support disc 44 can be coaxially rotated with the roller tube 12 without driving the variable diameter screw 41 to rotate.

The support disc 44 supports the variable diameter screw 41 in the roller tube 12, which prevents the variable diameter screw 41 from being bent by its own weight. However, in embodiments not provided with a support disc, such problem can be still overcome merely through the adjustment in the material of the variable diameter screw 41.

With the above design, when the roller tube 12 rotates in a first rotation direction R1, the elastic member will be moved along the working section of the variable diameter screw 41 from the first end P1 toward the second end P2, causing deformation. Whereby, a gradually increasing unit tightening force will be exerted to the variable diameter screw in the radial direction, dampening the rotation of the roller tube 12 in the first rotation direction R1. On the other hand, when the roller tube 12 is rotated in a second rotation direction opposite to the first rotation direction R1, the unit tightening force exerted by the elastic member to the variable diameter screw in the radial direction will gradually decrease.

With the aforementioned arrangements, when the covering material 11 is being lifted or expanded, the elastic member and the roller tube 12 rotate synchronously, wherein the elastic member moves in an axial extension direction of the variable diameter screw, generating a variable friction between the elastic member and the variable diameter screw. In this way, when the operation stops, the position of the covering material 11 of the window covering could be precisely fixed. Furthermore, in consideration of the change in the effective weight applied to the roller tube 12 while the covering material 11 is being lifted or expanded, the present invention uses a variable diameter screw which has a working section broadening in the radial direction, so that the unit tightening force exerted to the variable diameter screw could be changed in a way that corresponds to the degree of expansion of the covering material 11 during the rotation of the roller tube 12, whereby to precisely fix the position of the covering material 11.

Further, the rotation of the roller tube 12 is caused by the equilibrium between the weight corresponding to the lifting or lowering of the covering material 11, the restoring force provided by the power mechanism 14, and the manual operating force. The stillness of the roller tube 12 corresponds to the equilibrium between the aforesaid weight, restoring force, and friction. With the position-fixing system of the present invention, the covering material 11 could be precisely stopped at where it is when the operation stops, without being shifted upward or downward. In addition, the position-fixing system of the present invention can be applied in all kinds of window coverings with roller tubes; it could be operated easily, and could provide the effects of immediate and reliable position-fixing.

It must be pointed out that the embodiments described above are only some preferred embodiments of the present invention. All equivalent structures which employ the concepts disclosed in this specification and the appended claims should fall within the scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A position-fixing system for a window covering, wherein the window covering has a covering material, a roller tube, and a support; the roller tube is pivotably connected to the support; the covering material has an end connected to the roller tube, and is adapted to be expanded from or wound around the roller tube; the position fixing system comprising:

a variable diameter screw, which is fixedly connected to the support, wherein the variable diameter screw is defined to have an axis, and is defined to have a first end and a second end in an extension direction of the axis; the variable diameter screw has a working section, which gradually and radially broadens in a direction from the first end toward the second end;

a guiding portion connected to an inner wall of the roller tube, wherein the guiding portion extends in an axial direction of the roller tube; and an elastic member fitting around the variable diameter screw, wherein the elastic member is adapted to slide along the guiding portion; the elastic member has a meshing portion provided along an inner side thereof and a guided portion provided along an outer side thereof; at least a part of the meshing portion meshes with the working section of the variable diameter screw; the guided portion contacts the guiding portion, and is adapted to slide along the guiding portion;

wherein, when the roller tube rotates in a first rotation direction, the elastic member moves along the working section of the variable diameter screw in a direction from the first end toward the second end, and the elastic member deforms correspondingly; as the elastic member is moved towards the second end of the variable diameter screw and deforms more, the elastic member exerts a gradually increasing unit tightening force to the variable diameter screw in a radial direction of the variable diameter screw, whereby to dampen a rotation of the roller tube in the first rotation direction.

2. The position-fixing system of claim 1, wherein the guiding portion is a rib; the guided portion of the elastic member is a groove, which abuts against at least one side of the rib, and is adapted to slide along the rib.

3. The position-fixing system of claim 1, wherein the elastic member is a non-closed elastic ring of a thickness; the non-closed elastic ring has the inner side and the outer side of the elastic member; the meshing portion is provided on the inner side of the non-closed elastic ring, and the guided portion is provided on the outer side of the non-closed elastic ring; the meshing portion of the non-closed elastic ring meshes with the working section of the variable diameter screw.

4. The position-fixing system of claim 1, wherein the variable diameter screw comprises a screw body; the screw body has threads provided on an outer wall thereof; the threads have crests and troughs, wherein the working section is constituted by at least part of the crests or at least part of the troughs.

5. The position-fixing system of claim 4, wherein a radius of the screw body gradually increases in the direction from the first end toward the second end.

6. The position-fixing system of claim 4, wherein a depth of the threads gradually increases in the direction from the first end toward the second end.

7. The position-fixing system of claim 1, wherein the elastic member is an enclosed elastic ring of a thickness, and is slightly elliptical; the enclosed elastic ring has the inner side and the outer side of the elastic member; the meshing portion is provided on the inner side of the enclosed elastic ring; the guided portion is provided on the outer side of the enclosed elastic ring; the meshing portion of the enclosed elastic ring meshes with the working section of the variable diameter screw.

8. The position-fixing system of claim 7, wherein the meshing portion comprises a plurality of teeth.

9. The position-fixing system of claim 7, wherein the elastic member is defined to have two sides in an axial direction thereof; the meshing portion comprises at least a pair of symmetrical teeth, each of which is located on one of the sides of the elastic member.

10. The position-fixing system of claim 7, wherein the enclosed elastic ring has a curved groove provided on the inner side thereof; the curved groove and the guided portion are in a same radial direction of the variable diameter screw.

11. The position-fixing system of claim 1, wherein the elastic member is a tightening spring, which comprises a main body and two ends; a side of the main body facing the variable diameter screw is the inner side, and another side of the main body facing the roller tube is the outer side; a part of the main body meshing with the variable diameter screw forms the working section, and the two ends form the guided portion.

12. The position-fixing system of claim 11, further comprising a support disc, which is adapted to slide along the inner wall of the roller tube, and is rotatable coaxially with the roller tube; the support disc is connected to the variable diameter screw, and is adapted to rotate relative to the variable diameter screw.

13. The position-fixing system of claim 11, wherein a distance between the two ends of the tightening spring is greater than a width of the guiding portion; any one of the ends of the tightening spring abuts against a side of the guiding portion to slide along the guiding portion.

14. The position-fixing system of claim 13, wherein the support disc has a disc body, an insert groove recessed into a circumference of the disc body, and a holding portion extending from the disc body toward the working section of the variable diameter screw; the guiding portion comprises a rib; the variable diameter screw has a rim extending in the radial direction thereof; the insert groove matches the rib, and the disc body is adapted to slide in the roller tube along the rib; the holding portion of the support disc holds the rim of the variable diameter screw in a snap-fitting way, whereby the support disc is adapted to rotate axially with the roller tube, without driving the variable diameter screw to rotate.

15. The position-fixing system of claim 1, further comprising a space adjacent to the elastic member, so that the elastic member is allowed to deform toward the space.

16. The position-fixing system of claim 15, wherein the elastic member is a non-closed elastic ring of a thickness, wherein the non-closed elastic ring is defined to have two ends in a circumferential direction thereof; a side of the non-closed elastic ring facing the variable diameter screw is defined to be the inner side, and another side of the non-closed elastic ring facing the roller tube is defined to be the outer side; the space is located between the two ends of the non-closed elastic ring; when the non-closed elastic ring is moved along the variable diameter screw between the first end and the second end, the space decreases as the working section increases in the radial direction.

17. The position-fixing system of claim 16, wherein the elastic member is integrally made of silicone or rubber.

18. The position-fixing system of claim 17, further comprising a non-closed rigid ring fitting around the non-closed elastic ring, whereby to provide an inward holding force to the non-closed elastic ring.

19. The position-fixing system of claim 15, wherein the elastic member is an enclosed elastic ring of a thickness, and is slightly elliptical; the enclosed elastic ring has the inner side and the outer side of the elastic member; the meshing portion is provided on the inner side of the enclosed elastic ring, and the guided portion is provided on the outer side of the enclosed elastic ring; the space is located between the enclosed elastic ring and the roller tube.

20. The position-fixing system of claim 19, wherein the elastic member is integrally made of silicone or rubber.

* * * * *